US006906680B2

(12) United States Patent
Rawnick et al.

(10) Patent No.: US 6,906,680 B2
(45) **Date of Patent: *Jun. 14, 2005**

(54) CONDUCTIVE FLUID GROUND PLANE

(75) Inventors: James J. Rawnick, Palm Bay, FL (US); Timothy E. Durham, Palm Bay, FL (US); Stephen B. Brown, Palm Bay, FL (US)

(73) Assignee: Harris Corporation, Melbourne, FL (US)

( * ) Notice: Subject to any disclaimer, the term of this patent is extended or adjusted under 35 U.S.C. 154(b) by 23 days.

This patent is subject to a terminal disclaimer.

(21) Appl. No.: 10/625,977

(22) Filed: Jul. 24, 2003

(65) Prior Publication Data

US 2005/0017905 A1 Jan. 27, 2005

(51) Int. Cl.[7] ..... H01Q 1/48
(52) U.S. Cl. ..... 343/846; 343/700 MS
(58) Field of Search ..... 343/846, 909, 343/701, 700 MS, 847

(56) References Cited

U.S. PATENT DOCUMENTS

| | | | | |
|---|---|---|---|---|
| 4,851,858 A | * | 7/1989 | Frisch | 343/779 |
| 5,087,922 A | * | 2/1992 | Tang et al. | 343/814 |
| 5,792,236 A | | 8/1998 | Taylor et al. | 75/715 |
| 6,191,740 B1 | * | 2/2001 | Kates et al. | 343/700 MS |
| 6,512,496 B2 | | 1/2003 | Alexeff et al. | 343/915 |
| 2003/0160724 A1 | * | 8/2003 | Alexeff et al. | 343/701 |
| 2004/0125019 A1 | * | 7/2004 | Rawnick et al. | 343/700 MS |
| 2004/0130497 A1 | | 7/2004 | Alexeff et al. | 343/725 |

OTHER PUBLICATIONS

U.S. Appl. No. 10/330,756, filed Dec. 27, 2002, Rawnick et al.
U.S. Appl. No. 10/626,090, filed Jul. 24, 2003, Brown et al.
U.S. Appl. No. 10/632,632, filed Aug. 1, 2003, Rawnick et al.
U.S. Appl. No. 10/614,149, filed Jul. 7, 2003, Brown et al.
U.S. Appl. No. 10/620,483, filed Jul. 16, 2003, Brown et al.
U.S. Appl. No. 10/640,237, filed Aug. 13, 2003, Rawnick et al.
U.S. Appl. No. 10/648,913, filed Aug. 27, 2003, Brown et al.
U.S. Appl. No. 10/414,695, filed Apr. 16, 2003, Rawnick et al.
U.S. Appl. No. 10/460,947, filed Jun. 13, 2003, Rawnick et al.
U.S. Appl. No. 10/421,305, filed Apr. 23, 2003, Rawnick et al.
U.S. Appl. No. 10/648,887, filed Aug. 27, 2003, Rawnick et al.

* cited by examiner

*Primary Examiner*—Don Wong
*Assistant Examiner*—Ephrem Alemu
(74) *Attorney, Agent, or Firm*—Sacco & Associates, PA

(57) ABSTRACT

Antenna system (100) with dynamically adjustable ground plane spacing. The system includes at least one antenna radiating element (106, 108) and a first conductive ground plane (110, 120) spaced from radiating element (106, 108). The first conductive ground plane is comprised of a dielectric structure (104) containing a conductive fluid (120).

21 Claims, 6 Drawing Sheets

CONDUCTIVE FLUID GROUND PLANE

BACKGROUND OF THE INVENTION

1. Technical Field

The invention concerns ground plane systems used in RF applications and more particularly, ground planes that can be dynamically added and removed from an RF system.

2. Description of the Related Art

Ground planes are widely used in RF systems for a variety of applications. For example, ground planes are often used in microwave antenna systems as reflectors and shielding elements. When used as reflector elements, ground planes are commonly spaced a multiple of one quarter wavelength from a radiating element. Common configurations include a plurality of antenna elements arranged on one side of a dielectric sheet to form an array with the ground plane spaced on an opposing side of the dielectric sheet or spaced below the sheet. In either case, such arrangements provide satisfactory results and have been widely used where the radiating elements are only required to operate over a narrow band of frequencies.

Even in those instances where two or more sets of radiating elements are disposed on a common surface of one dielectric sheet, a single ground plane can be used if the radiating elements operate on a harmonically related set of frequencies, provided that the spacing between the radiating elements and the ground plane is maintained at some multiple of a quarter wavelength at the operating frequency.

A more difficult problem arises when the antenna radiators are designed to operate over multiple bands of RF frequencies that are not harmonically related. One technique uses a stepped ground plane arrangement in which groups of radiating element for each frequency are positioned in selected areas of the dielectric substrate. The ground plane in the area beneath each group of radiating elements is stepped up or down to provide the proper spacing needed for operation for each group of antenna elements. However, the use of this stepped approach can present engineering tradeoffs that negatively affect the operation of each antenna array.

SUMMARY OF THE INVENTION

The invention concerns an antenna system with dynamically adjustable ground plane spacing. The system includes at least one antenna radiating element and a first conductive ground plane spaced from radiating element. The first conductive ground plane is comprised of a dielectric structure containing a conductive fluid.

According to one aspect of the invention, the antenna system can include a plurality of antenna radiating elements disposed on a substrate surface. At least one set of the plurality of antenna radiating elements can be dimensioned for operating on a separate frequency band as compared to a second set of the plurality of antenna radiating elements. In that case, a second conductive ground plane can be provided with the first conductive ground plane disposed between the second conductive ground plane and the radiating elements.

The conductive fluid can be disposed within a cavity defined within the dielectric structure. The dielectric structure can be formed as a continuous sheet between the antenna radiating elements and the second conductive ground plane. The conductive fluid can be disposed within one or more large cavities contained within the dielectric structure or can be disposed within a network of channels defined within the dielectric structure. If a network of channels is used, they can be arranged in the form of a crisscross or grid pattern. The network can be arranged and dimensioned so to prevent the transmission of RF through the network of channels at an operating frequency of the antenna radiating element.

The conductive fluid used with the present invention can be any fluid that has a high degree of conductivity. For example, the conductive fluid can be selected from one or more of the conductive fluid used in the invention can be selected from the group consisting of a metal or metal alloy that is liquid at room temperature. The most common example of such a metal would be mercury. However, other electrically conductive, liquid metal alloy alternatives to mercury are commercially available, including alloys based on gallium and indium alloyed with tin, copper, and zinc or bismuth. These alloys, which are electrically conductive and non-toxic, are described in greater detail in U.S. Pat. No. 5,792,236 to Taylor et al, the disclosure of which is incorporated herein by reference. Other conductive fluids include a variety of solvent-electrolyte mixtures that are well known in the art. Other conductive fluids include a variety of solvent-electrolyte mixtures that are well known in the art. The dielectric can remain empty after the conductive fluid has been removed or it can be filled with a dielectric fluid. A fluid control system can be provided for selectively injecting and/or purging the conductive fluid and the dielectric fluid from the dielectric structure responsive to a control signal. For example, the control system can include one or more pumps, valves, and conduits.

The invention can also include a method for dynamically changing an effective distance between an antenna radiating element and a ground plane. The method can include the steps of positioning the antenna radiating element at a location spaced from a dielectric structure. Subsequently, in response to a control signal, a conductive fluid can be injected into at least one cavity contained within the dielectric structure to form a first ground plane for the antenna radiating element. The method can also include the step of purging the conductive fluid responsive to a control signal to expose the antenna radiating elements to a second conductive ground plane. The purging step can also include the step of replacing the conductive fluid with a dielectric fluid.

According to another aspect of the method, a plurality of the antenna radiating elements can be positioned on a substrate surface and at least one set of the plurality of antenna radiating elements can be dimensioned for operating on a separate frequency band as compared to a second set of the plurality of antenna radiating elements. The method can also include the step of positioning the dielectric structure at a location disposed between the radiating elements and the second conductive ground plane so that upon the purging of the conductive fluid, the radiating elements are exposed to the second conductive ground plane.

DETAILED DESCRIPTION OF THE PREFERRED EMBODIMENTS

Figure 1:
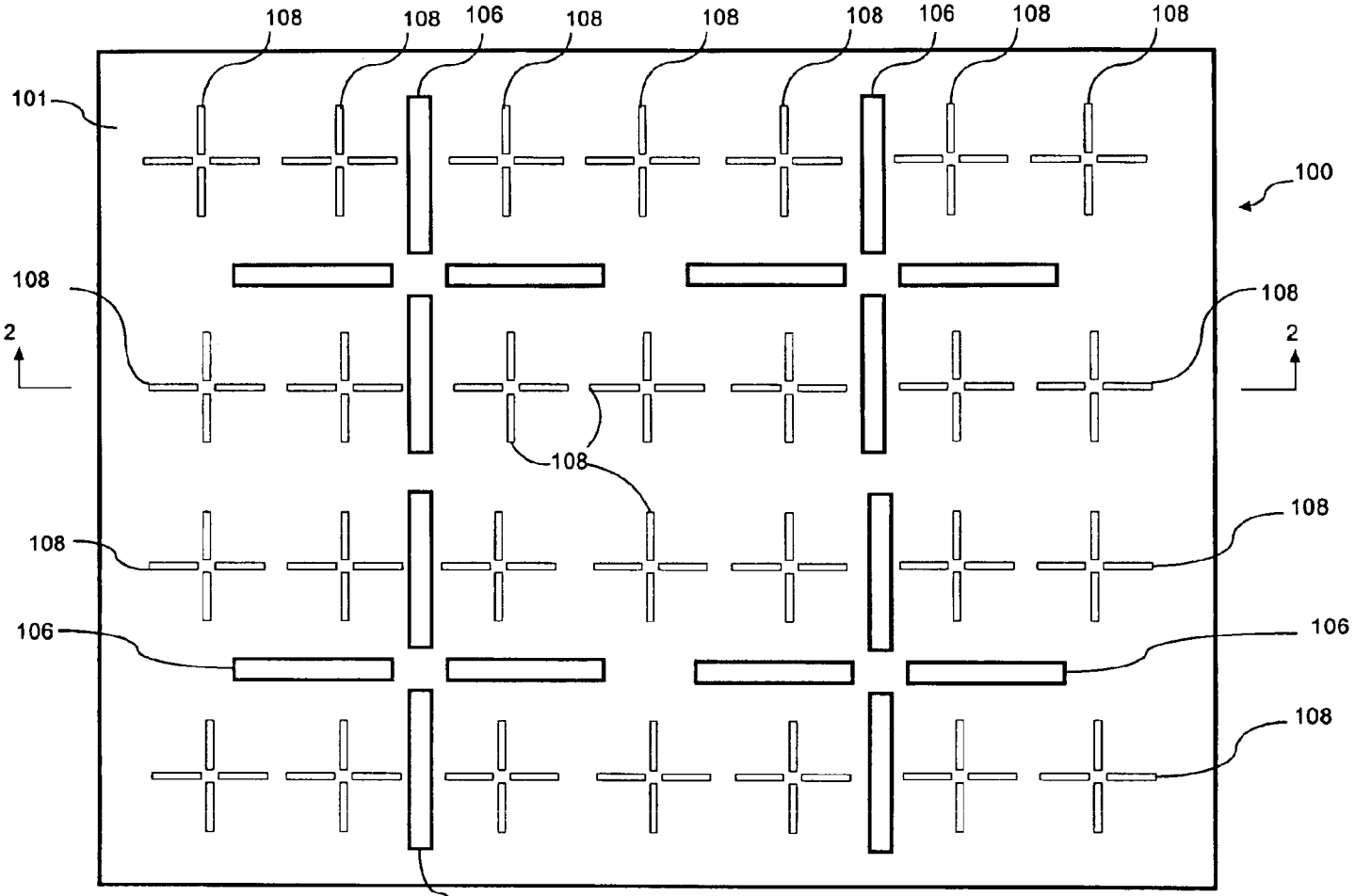
FIG. 1 is a top view of an antenna system that is useful for understanding the present invention.

A top view of an antenna system in which the invention can be used is illustrated in FIG. 1. The antenna system 100 is comprised of a plurality of antenna radiating elements, including a set of high frequency elements 108 and a set of low frequency elements 106. Antenna radiating elements arranged in this manner are commonly mounted on a suitable dielectric substrate 101 as shown, although the invention is not limited in this regard. Instead, any suitable element mounting system can be used. Also, in FIG. 1 the antenna elements 106, 108 are comprised of orthogonal dipoles mounted on a dielectric substrate 101. However, the invention is not so limited and those skilled in the art will appreciate that the invention described herein can be used with any type of antenna element requiring a ground-plane. For example, the invention can be used with a wide variety of radiating element geometries including, without limitation, patches, slots, and spirals.

Each of the antenna elements 106, 108 can be operated independently. Alternatively, in a preferred embodiment, the low frequency elements 106 and the high frequency elements 108 can each be used to form two separate arrays. The independent arrays can be used to facilitate beam-forming and beam steering in the antenna system. Also, in FIG. 1, there are four low frequency antenna elements 106 and twenty-eight high frequency antenna elements 108 that are shown. However, it should be understood that the present invention is not limited to any particular number of antenna elements or any particular array pattern, the arrangement shown in FIG. 1 being merely exemplary of one possible dual band antenna system with two types of radiating elements requiring. Further, while there are only two types of antenna elements 106, 108 for two operating bands that are illustrated in FIG. 1, the invention can also include additional sets of radiating elements for a third or fourth operating band.

Notably, the radiating elements 106, 108 in FIG. 1 each require a conductive ground plane to be disposed beneath them at a predetermined spacing. For example, a ground plane is commonly spaced one quarter wavelength or, some multiple thereof, beneath the antenna elements for maximum efficiency. In those instances where the radiating elements 106, 108 are not designed for operation on frequency bands that are harmonically related, it may be impossible or otherwise impractical to implement a spacing that satisfies the requirements for two or more types of antenna radiating elements 106, 108. In those instances, a separate array panel would ordinarily be required with different ground plane spacing. In order to overcome these and other limitations of the prior art, the antenna system 100 can make use of a ground plane system as illustrated in FIG. 2.

Figure 2:
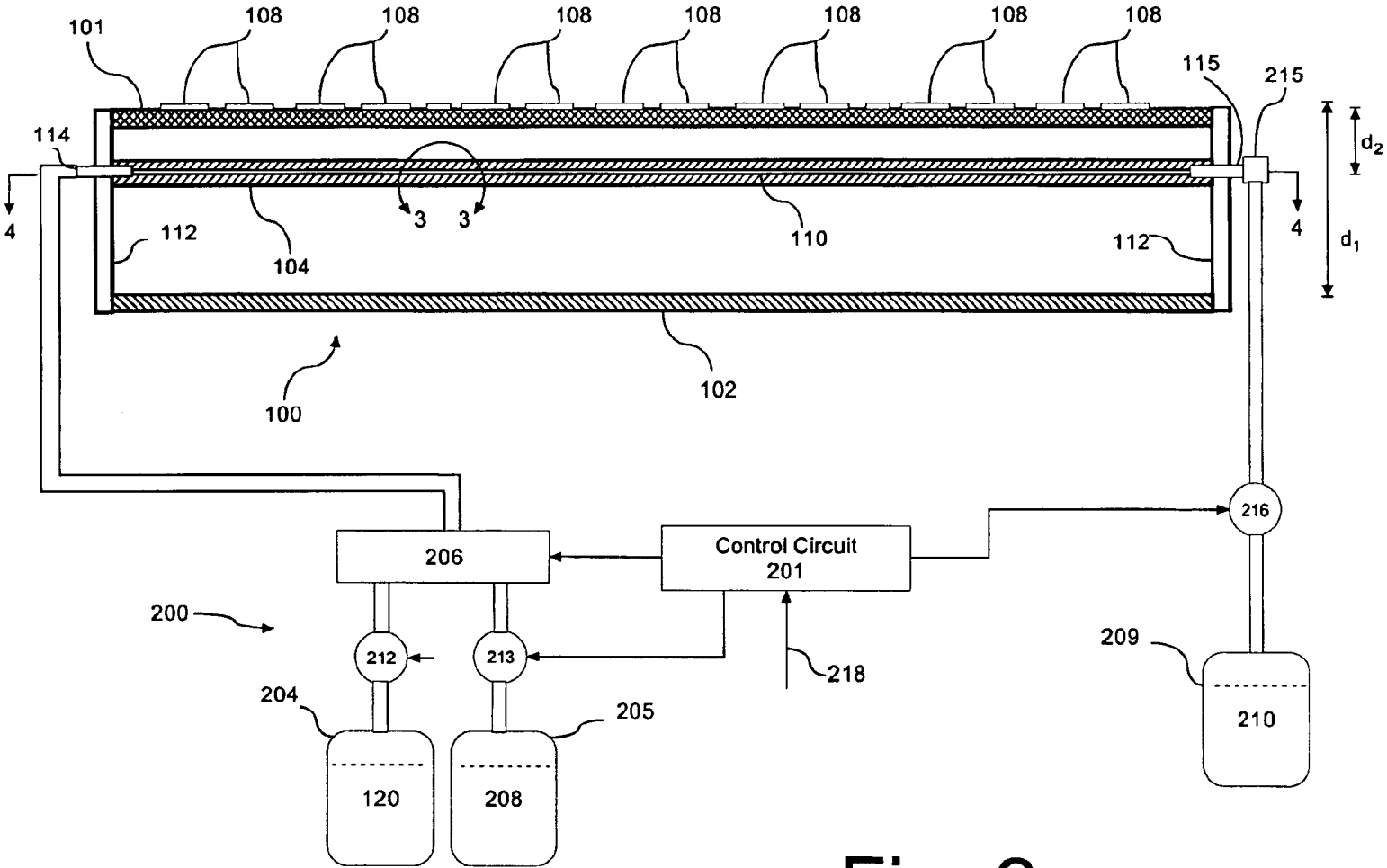
FIG. 2 is a cross-sectional view of the antenna system of FIG. 1 taken along line 2—2.

FIG. 2 is a cross-sectional view of the antenna system 100 taken along line 2—2 in FIG. 1. The ground system can include a conventional ground plane 102 made from a conductive metal. For example a sheet of brass, copper or aluminum could be used for this purpose. The conventional ground plane 102 is preferably spaced at a distance from the antenna radiating elements equal to approximately a quarter wavelength at the lowest operating frequency of interest. For example, in the case of the antenna elements 106, 108 the conventional ground plane 102 could be spaced from antenna elements by a distance of $d_1$ which can be approximately one quarter wavelength at the operating frequency of the antenna element 106.

Figure 3:
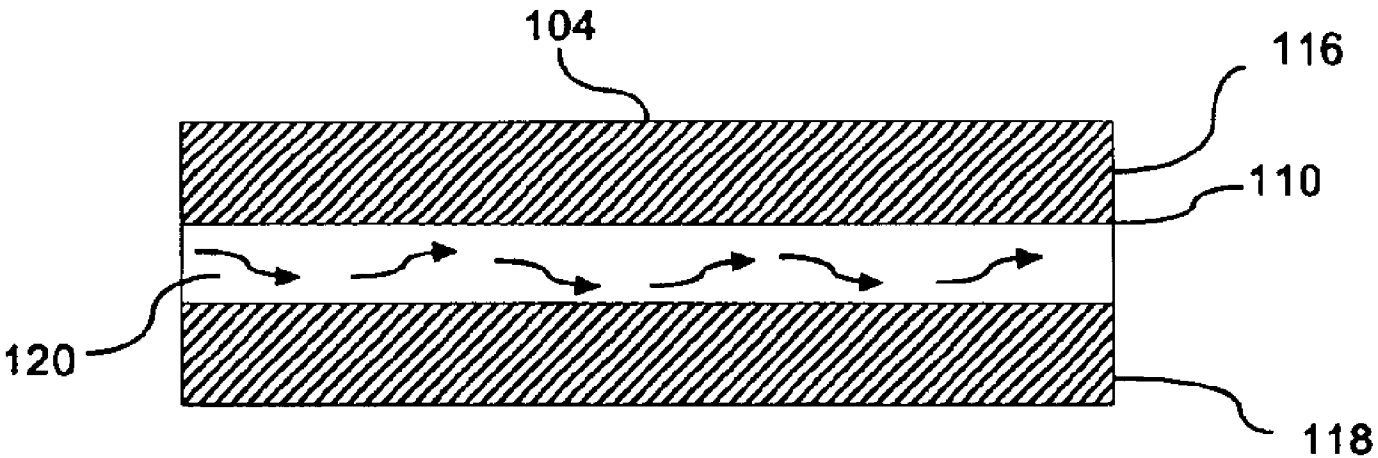
FIG. 3 is an enlarged view of a portion of the dielectric structure in FIG. 2.

In order to accommodate a second ground plane spacing $d_2$ that may be necessary for a second type of antenna radiating element, such as elements 108, a dynamically implemented fluidic ground plane can be provided. As shown in FIG. 2, the fluidic ground plane can be comprised of a dielectric structure 104 disposed at some distance between the antenna radiating elements and the conventional ground plane 102. The dielectric structure preferably includes at least one cavity 110 formed within or as part of the dielectric structure and which can be filled with a conductive fluid. FIG. 3 is an enlarged view of a portion of the dielectric structure 104 in which a cavity 110 is shown disposed between upper and lower dielectric panel portions 116, 118 with a conductive fluid 120 contained therein.

Figure 4A:
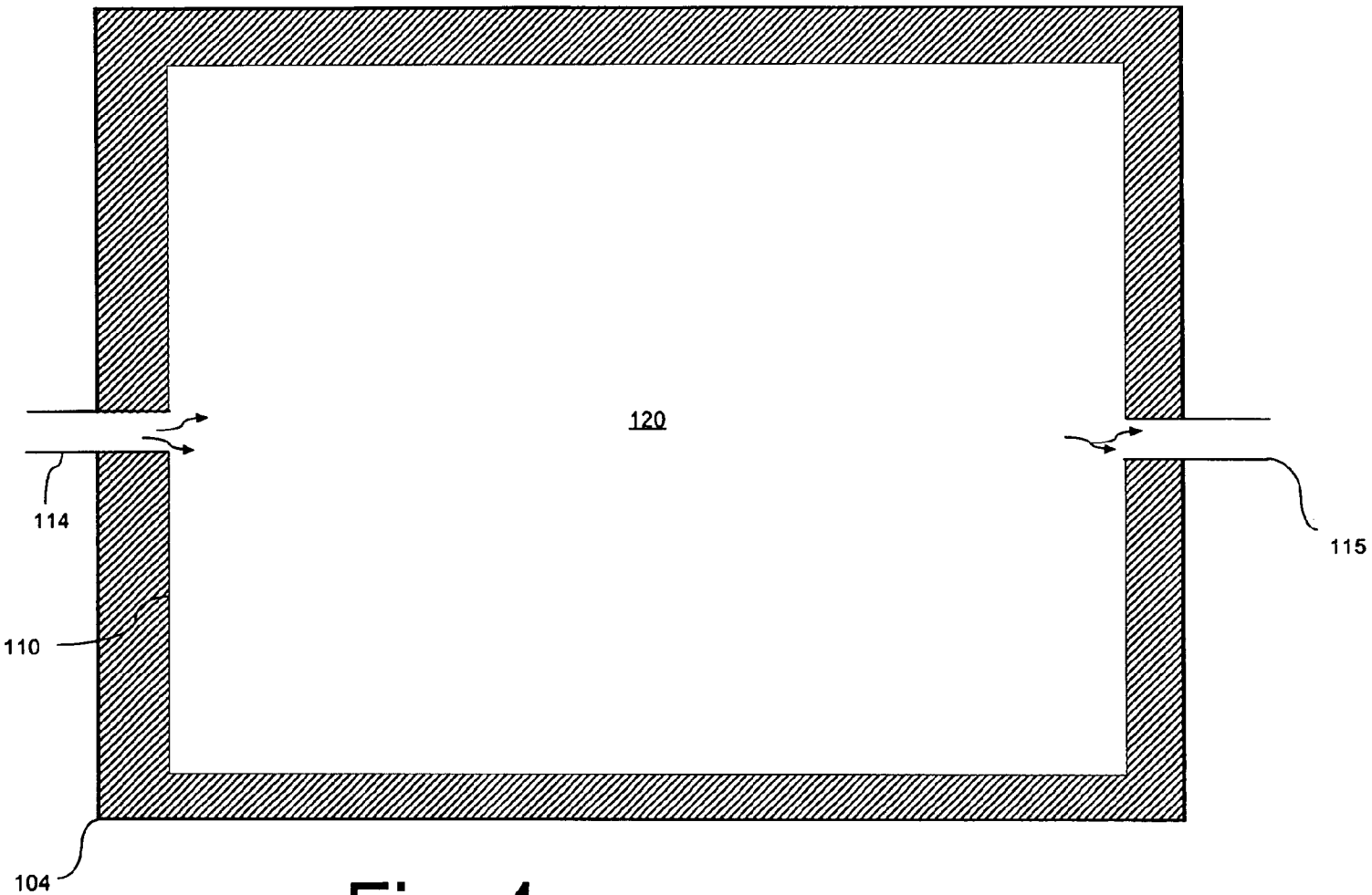
FIG. 4*a* is a cross-sectional view of the dielectric structure taken along line 4—4 in FIG. 2.
Figure 4B:
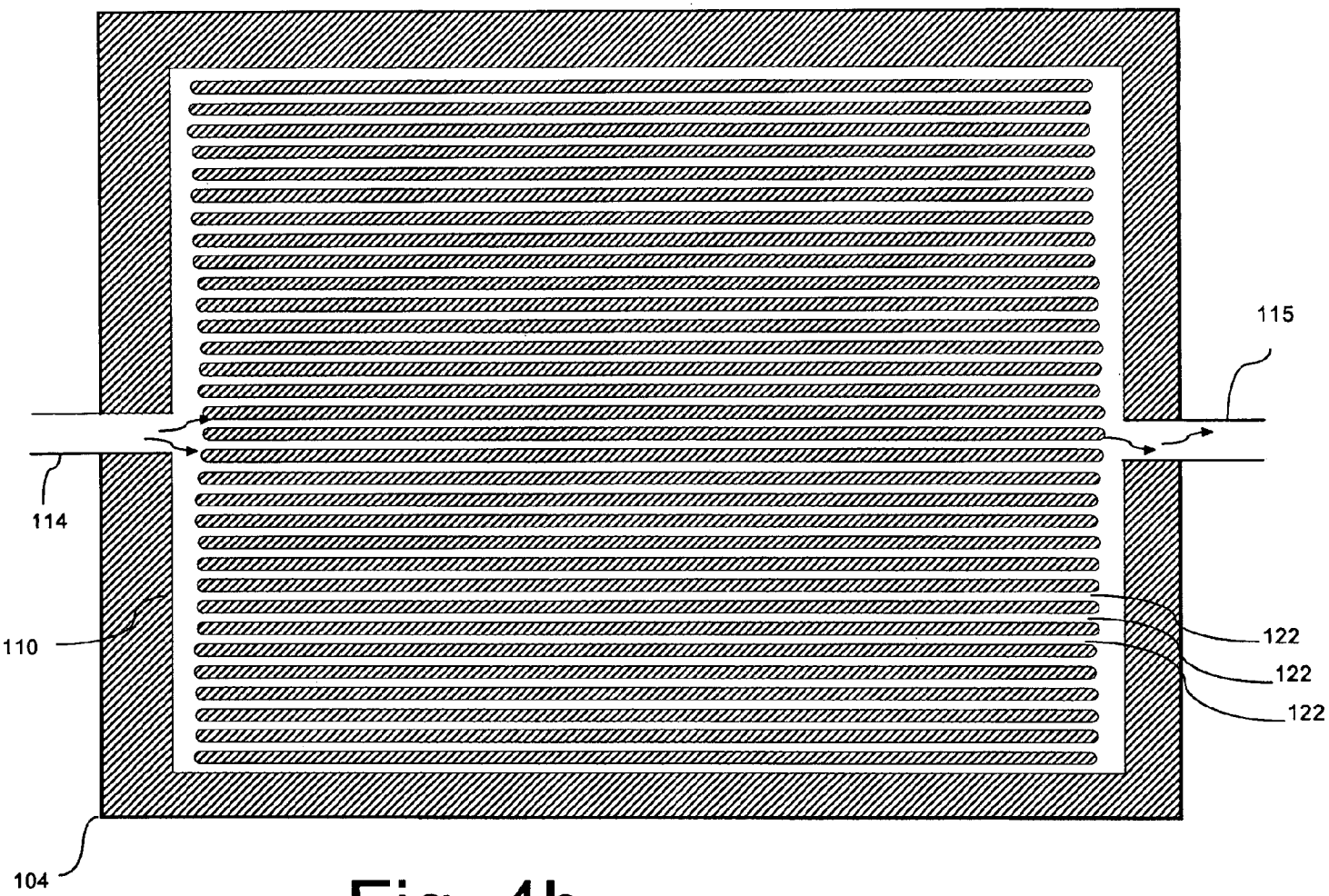
FIG. 4*b* is a cross-sectional view of an alternative embodiment of the dielectric structure taken along line 4—4 in FIG. 2.
Figure 4C:
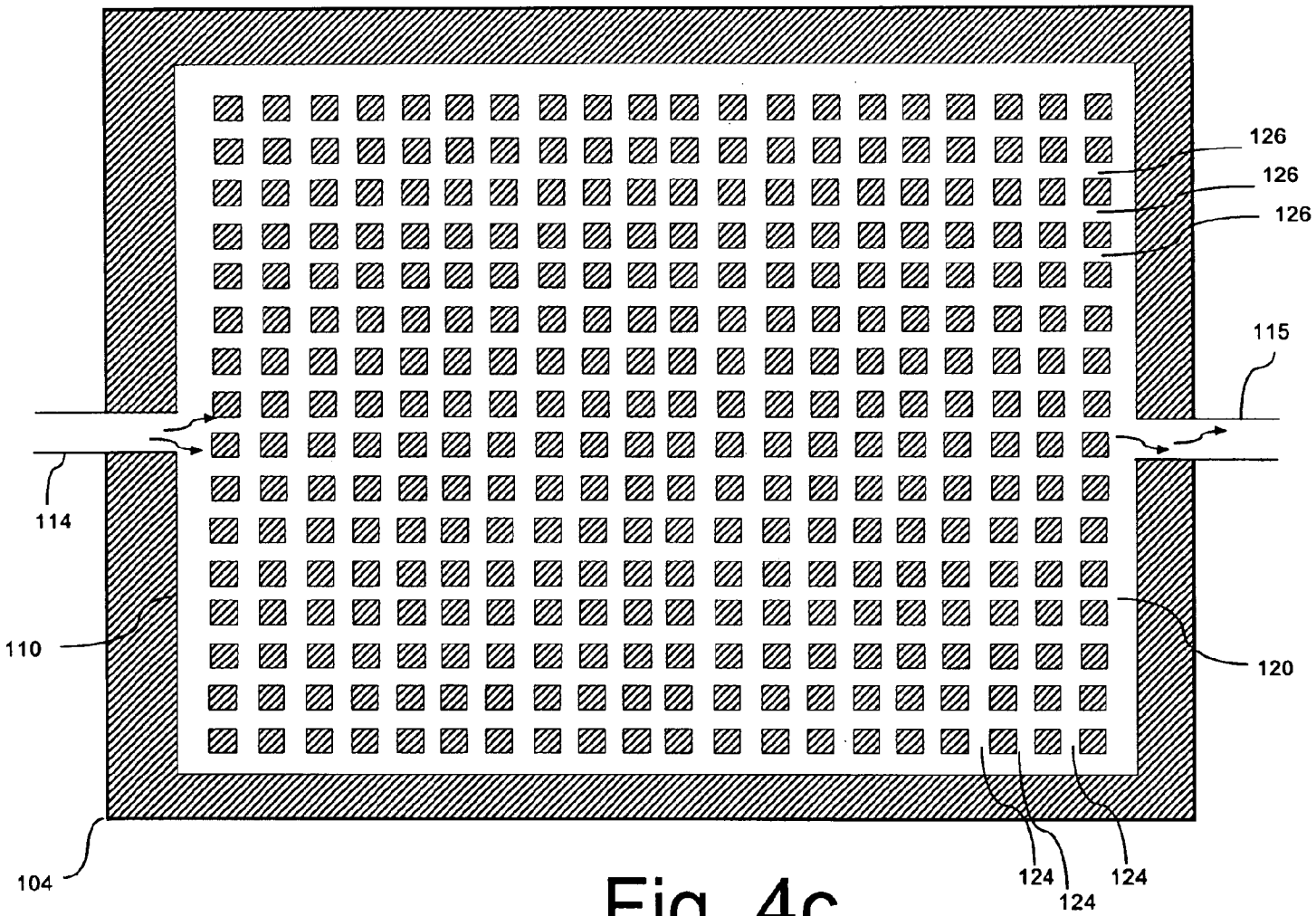
FIG. 4*c* is a cross-sectional view of a second alternative embodiment of the dielectric structure taken along line 4—4 in FIG. 2.

In the most basic form, the invention can be implemented using a single cavity 110 that can be approximately commensurate with the area beneath that portion of the antenna system 100 where the antenna radiating elements 106, 108 are disposed. For example, the cavity could be arranged so that it is generally continuous throughout a portion of the area beneath the dielectric substrate 101. FIG. 4*a* is a cross-sectional view of the antenna system 100 taken along line 4—4 in FIG. 2 that illustrates this basic embodiment. However, the cavity structure is not so limited and other embodiments are also possible. For example, as illustrated in FIG. 4*b*, the fluid cavity 110 can be arranged with a plurality of individual elongated fluid channels 122. Alternatively, as illustrated in FIG. 4*c*, the dielectric structure 104 can be formed so as to create a crisscross pattern of channels 124, 126 to define a conductive grid or screen. The precise size and spacing of the fluid channels or grid will depend upon the frequency of operation of the radiating elements for which the conductive screen is intended to define a ground plane. Higher frequencies will require smaller channel spacing in order to present an effective ground plane while lower frequency operation may permit larger spacing between adjacent channels. In any case the exact arrangement or geometry of the channels is not crucial to the invention, provided that the overall channel structure provides an apparent ground plane for the frequency band or bands of interest. If necessary, suitable conduits (not shown) can be formed in the dielectric for permitting antenna feed lines to traverse a portion of the conductive fluid comprising the ground plane. The dielectric material forming the conduit can be used to isolate the antenna feed lines from the conductive ground plane for accommodating the transmission of RF energy to antenna elements.

Regardless of the particular structure selected for the fluid cavity 110, the conductive fluid 120 can be injected into the fluid cavity 110 by means of a suitable fluid transfer conduit 114. Fluid transfer conduit 114 can be seen in FIGS. 2 and 4*a*–*c*. A second fluid transfer conduit 115 can also be provided for permitting the conductive fluid 120 to be purged from the fluid cavity. By selectively injecting the conductive fluid 120 into the cavity, a ground plane can be established at a pre-determined distance between the conventional ground plane 102 and from the antenna elements 106, 108. Subsequently, by purging the conductive fluid 120 from the cavity 110, the ground plane can be removed. Consequently the presence or absence of the ground plane defined by the dielectric structure 104 and the conductive fluid 120 can be dynamically controlled.

Referring once again to FIG. 2, it can be seen that the invention preferably includes a fluid control system 200 for selectively controlling the presence or removal of the conductive fluid 120 from the cavity 110. The fluid control system can comprise any suitable arrangement pumps, valves, conduits and controllers that is operable for effectively injecting and removing conductive fluid 120 from the cavity 110 in response to a control signal. A wide variety of such fluid control systems may be implemented by those skilled in the art. For example, in one embodiment, the fluid control system can include a reservoir 204 for conductive fluid 120 and a pump 212 for injecting the conductive fluid into the cavity 110. When it is desired to purge the conductive fluid from the cavity 110, a pump 216 can be used to draw the conductive fluid from the cavity 110. At least one control valve 215 can be provided to allow the conductive fluid to be maintained within the cavity 110 or purged as needed. The control valve 215 can be responsive to a control signal (not shown) from the control circuit 201.

In order to ensure a more complete removal of all conductive fluid from the cavity 110, one or more pumps 213 can be used to inject a dielectric solvent 208 into the cavity 110. The dielectric solvent 208 can be stored in a second reservoir 205 and can be useful for ensuring that the conductive fluid is completely and efficiently flushed from the cavity 110. A control valve 206 can be used to selectively control the flow of conductive fluid 120 and dielectric solvent 208 into the cavity 110. A mixture 210 of the conductive fluid 120 and any excess dielectric solvent 208 that has been purged from the cavity 110 can be collected in a recovery reservoir 209. For convenience, additional fluid processing, not shown, can also be provided for separating dielectric solvent from the conductive fluid contained in the recovery reservoir for subsequent reuse. However, the additional fluid processing is a matter of convenience and not essential to the operation of the invention.

A control circuit 201 can control the operation of the various valves 206, 215 and pumps 212, 213, 216 necessary to inject and purge the conductive fluid and/or dielectric solvent from the cavity 110. The control circuit 201 can be responsive to an analog or digital control signal 218 for selectively controlling the presence and removal of the conductive fluid and the dielectric solvent from the cavity 110. It should be understood that the fluid control system 200 is merely one possible implementation among many that could be used to inject and purge conductive fluid from the cavity 110 and the invention is not intended to be limited to any particular type of fluid control system. All that is required of the fluid control system is the ability to effectively control the presence and removal of the conductive fluid 120 from the cavity 110.

The invention is not limited to any particular conductive fluid or dielectric solvent. Suitable materials for this purpose can include any suitable metal or metal alloy that is liquid at room temperature. The most common example of such a metal would be mercury. However, other electrically conductive, liquid metal alloy alternatives to mercury are commercially available, including alloys based on gallium and indium alloyed with tin, copper, and zinc or bismuth. These alloys, which are electrically conductive and non-toxic, are described in greater detail in U.S. Pat. No. 5,792,236 to Taylor et al, the disclosure of which is incorporated herein by reference. Other conductive fluids include a variety of solvent-electrolyte mixtures that are well known in the art. As for conductivity, there are several options. Both a conductive "plate" and a very high (relatively to the material adjacent to it) dielectric interface will cause an incident wave to reflect but only a conductive fluid will allow the necessary ground currents to flow. Using a perfect conductor, all energy is reflected. Using a non-perfect conductor, some energy will pass through and some will be dissipated as heat in the conductive material. Conductivities greater than 20 would be desirable, although effective systems could be employed utilizing conductivities as low as 1 or 2.

We claim:

1. An antenna system, comprising:

at least one antenna radiating element;

a first conductive ground plane spaced from said at least one antenna radiating element, said first conductive ground plane comprising a conductive fluid disposed within at least one cavity defined within a dielectric structure; and wherein said conductive fluid is disposed within a network of channels defined within said dielectric structure.

2. The antenna system according to claim 1 wherein said network of channels are arranged in the form of a grid pattern.

3. The antenna system according to claim 1 wherein said network of channels are arranged and spaced so to prevent the transmission through said network of channels of RF at an operating frequency of said at least one antenna radiating element.

4. An antenna system, comprising:

at least one antenna radiating element;

a dielectric structure containing a conductive fluid, said conductive fluid defining a first conductive ground plane spaced from said at least one antenna radiating element; and at least one fluid control system responsive to a control signal, said fluid control system controlling a presence and absence of said first conductive ground plane by selectively adding and removing said conductive fluid to said dielectric structure.

5. The antenna system according to claim 4 further comprising a plurality of said antenna radiating elements disposed on a substrate surface, at least one set of said plurality of antenna radiating elements dimensioned for operating on a separate frequency band as compared to a second set of said plurality of antenna radiating elements.

6. The antenna system according to claim 4 further comprising a second conductive ground plane, said first conductive ground plane disposed between said second conductive ground plane and said at least one radiating element.

7. The antenna system according to claim 4 wherein said conductive fluid is selected from the group consisting of a metal or a metal alloy that is liquid at room temperature, and a solvent electrolyte mixture.

8. The antenna system according to claim 4 wherein said control system is comprised of at least one pump and one valve.

9. The antenna system according to claim 4 wherein said fluid control system replaces said conductive fluid with a dielectric fluid responsive to a second control signal.

10. The antenna system according to claim 4 wherein said conductive fluid is disposed within at least one cavity defined within said dielectric structure.

11. The antenna system according to claim 10 wherein said conductive fluid in said at least one cavity forms a continuous conductive sheet between said antenna radiating elements and a second conductive ground plane.

12. A method for dynamically changing an effective distance between an antenna radiating element and a ground plane, comprising the steps of:

positioning at least one antenna radiating element at a location spaced from a dielectric structure;

responsive to a control signal, injecting a conductive fluid into at least one cavity contained within said dielectric structure to form a first ground plane for said at least one antenna radiating element.

13. The method according to claim 12 further comprising the step of purging said conductive fluid responsive to a control signal to expose said at least one antenna radiating element to a second conductive ground plane.

14. The method according to claim 12 further comprising the step of forming said dielectric structure as a continuous sheet.

15. The method according to claim 12 further comprising the step of selecting said conductive fluid from the group consisting of a metal or a metal alloy that is liquid at room temperature, and a solvent electrolyte mixture.

16. The method according to claim 11 further comprising the step of replacing said conductive fluid with a dielectric fluid responsive to a second control signal.

17. The method according to claim 12 further comprising the steps of positioning a plurality of said antenna radiating elements on a substrate surface and dimensioning at least one set of said plurality of antenna radiating elements for operating on a separate frequency band as compared to a second set of said plurality of antenna radiating elements.

18. The method according to claim 17 further comprising the step of positioning said dielectric structure at a location disposed between said radiating elements and a second conductive ground plane.

19. The method according to claim 12 further comprising the step of injecting said conductive fluid into a network of channels defined within said dielectric structure.

20. The method according to claim 19 further comprising the step of arranging said network of channels in the form of a grid pattern.

21. The method according to claim 19 further comprising the step of arranging said network of channels with a spacing selected to prevent the transmission through said network of channels of RF at an operating frequency of said at least one antenna radiating element.

* * * * *

UNITED STATES PATENT AND TRADEMARK OFFICE

CERTIFICATE OF CORRECTION

PATENT NO. : 6,906,680 B2
DATED : June 14, 2005
INVENTOR(S) : Rawnick et al.

It is certified that error appears in the above-identified patent and that said Letters Patent is hereby corrected as shown below:

Column 7,
Line 18, delete "The method according to claim 11" and replace with
-- The method according to claim 12 --.

Signed and Sealed this

Tenth Day of January, 2006

JON W. DUDAS
*Director of the United States Patent and Trademark Office*